US008789469B1

(12) United States Patent
Evangelisti et al.

(10) Patent No.: US 8,789,469 B1
(45) Date of Patent: Jul. 29, 2014

(54) GRENADE PULL PIN ASSEMBLY

(71) Applicants: Matthew Evangelisti, Denville, NJ (US); Steve Kotefski, Bloomingdale, NJ (US)

(72) Inventors: Matthew Evangelisti, Denville, NJ (US); Steve Kotefski, Bloomingdale, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/037,731

(22) Filed: Sep. 26, 2013

(51) Int. Cl.
*F42B 27/08* (2006.01)

(52) U.S. Cl.
USPC ..... 102/486; 102/481; 102/487; 102/482

(58) Field of Classification Search
USPC ..... 102/486, 481, 487, 482
See application file for complete search history.

(56) References Cited

U.S. PATENT DOCUMENTS 2,562,928 A * 8/1951 Lewis ..... 102/261
3,103,171 A * 9/1963 Jans ..... 102/487
3,434,421 A * 3/1969 Berlin et al. ..... 102/487
3,616,753 A * 11/1971 Carlson ..... 102/487
3,762,330 A * 10/1973 Hall ..... 102/487
3,765,337 A * 10/1973 Padula ..... 102/487
3,823,669 A * 7/1974 Zacharin ..... 102/221
3,823,670 A * 7/1974 Zacharin ..... 102/487
4,513,667 A * 4/1985 Caruso ..... 102/487
4,811,470 A * 3/1989 Van Sloun ..... 24/453
4,926,752 A * 5/1990 DiRubbio et al. ..... 102/486
5,355,803 A * 10/1994 Robinet et al. ..... 102/487
5,886,288 A * 3/1999 Brunn ..... 102/482
6,272,995 B1 * 8/2001 Schmidt et al. ..... 102/209
6,792,868 B2 * 9/2004 Teilhol et al. ..... 102/487
7,275,486 B2 * 10/2007 Hsieh ..... 102/498
8,453,573 B1 * 6/2013 McKimm et al. ..... 102/487

* cited by examiner

*Primary Examiner* — Michelle Clement
(74) *Attorney, Agent, or Firm* — Michael C. Sachs

(57) ABSTRACT

A grenade fuze assembly includes a fuze body, a striker lever pivotally mounted to the fuze body, and a pull pin assembly. The pull pin assembly includes a pull pin attached to a pull ring and a pull pin retainer fixed to the pull pin on a side of the striker lever opposite the pull ring. The pull pin retainer includes a through hole. The two legs of the pull pin are disposed in the through hole and deformed around the retainer to fix the retainer to the pull pin. The retainer includes a pair of nest areas on opposing sides of the retainer. The free end of each of the two pull pin legs is disposed in a respective nest area.

18 Claims, 3 Drawing Sheets

Fig. 1 Prior Art
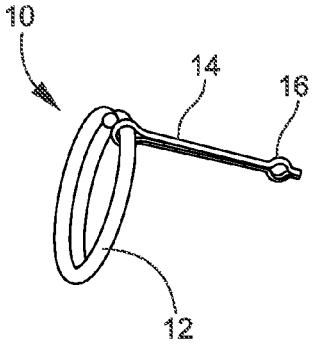
Fig. 2 Prior Art
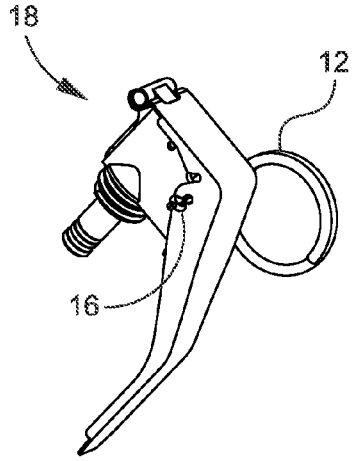
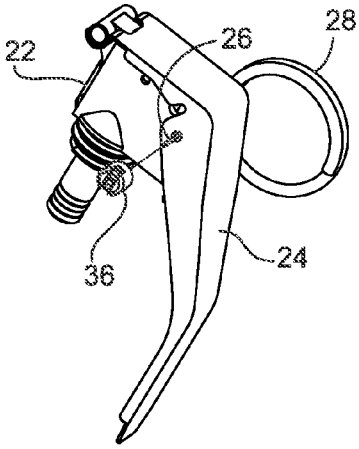
Fig. 3
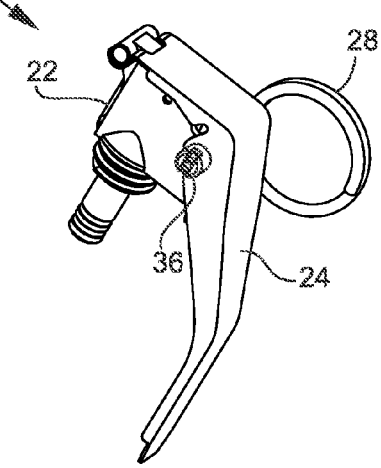
Fig. 4

GRENADE PULL PIN ASSEMBLY

STATEMENT OF GOVERNMENT INTEREST

The inventions described herein may be manufactured, used and licensed by or for the United States Government.

BACKGROUND OF THE INVENTION

The invention relates in general to grenades, and in particular to hand grenades.

A major concern with grenade fuze assemblies is the retention of the pull pin assembly. The pull pin assembly includes a pull ring and a pull pin. The pull pin has a retention requirement, that is, a pull force range required to pull the pin out of the grenade fuze. The pull force range may be, for example, about 20-25 pounds force. A known pull pin includes a "duck bill" shape that functions to retain the pull pin until the required pull force is applied.

FIG. 1 is a perspective view of a pull pin assembly 10 having a pull ring 12 and a pull pin 14. The pull pin 14 includes a "duck bill" portion 16. FIG. 2 is a perspective view of the pull pin assembly 10 in a grenade fuze 18. Problems with manufacturing the duck bill pull pin 14 include tooling, calibration, and verification of pull test requirements. It can be difficult to manufacture duck bill pull pins that meet the required pull force range. In addition, the duck bill pull pin has sharp edges or ends that can scratch and cut the user.

The grenade user may bend or deform the sharp ends of the duck bill pull pin to eliminate the exposed sharp edges. The grenade user may also bend or deform the sharp ends of the duck bill pull pin in an effort to increase what is perceived as an inadequate (too small) pull force. Bending or deforming the "duck bill" pull pin can drastically change the pull force needed to remove the pull pin from the fuze, leading to an unsafe grenade.

A need exists for a grenade pull pin that does not have sharp edges, that provides a more reliable and accurate pull out force, and that conveys confidence to the user that the pull force is adequate.

SUMMARY OF INVENTION

One aspect of the invention is a pull pin retainer for retaining a pull pin of a grenade fuze assembly. The pull pin retainer includes a generally cylindrical body, a central longitudinal axis, parallel top and bottom surfaces, and a through hole that is coaxial with the central longitudinal axis. A channel is formed in the top surface. The channel is centered on the central longitudinal axis and extends in a first direction completely across the top surface and partially across the top surface in a second direction normal to the first direction.

The pull pin retainer includes a planar surface that is normal to the central longitudinal axis, parallel to the top surface and located interior of the top surface. A pair of coplanar surfaces are disposed on respective opposite sides of the planar surface. The coplanar surfaces are parallel to the planar surface and located axially further from the top surface than the planar surface. A pair of second surfaces join respective ones of the pair of coplanar surfaces to the planar surface. A fulcrum is defined by the intersection of the through hole and the planar surface. A pair of second fulcrums are defined by intersections of the planar surface with respective ones of the pair of second surfaces.

The pull pin retainer includes a pair of nest areas. Each nest area is defined by an area that is radially outward of one of the second surfaces and axially above one of the coplanar surfaces that joins the one of the second surfaces.

The pair of second surfaces may be parallel to each other, normal to the planar surface, and normal to respective ones of the pair of coplanar surfaces.

The free ends of the pull pin may be disposed in respective ones of the pair of nest areas.

Another aspect of the invention is a grenade fuze assembly including a fuze body and a striker lever pivotally mounted to the fuze body. The grenade fuze assembly includes a pull pin assembly having a pull pin attached to a pull ring. The pull pin has two legs inserted through the striker lever and the fuze body to prevent rotation of the striker lever. The grenade fuze assembly includes a pull pin retainer disposed on a side of the striker lever opposite the pull ring. The pull pin retainer includes a through hole with the two legs of the pull pin disposed in the through hole and deformed around the retainer to fix the retainer to the pull pin. The retainer includes a pair of nest areas disposed on opposing sides of the retainer. The free end of each of the two legs is disposed in a respective nest area.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1 is a perspective view of a prior art pull pin assembly.

FIG. 2 is a perspective view of the assembly of FIG. 1 in a grenade fuze.

FIG. 3 is a perspective view of a grenade fuze with a pull pin retainer prior to assembly.

FIG. 4 is a perspective view of a grenade fuze with the pull pin retainer assembled.

DETAILED DESCRIPTION

Figure 5:
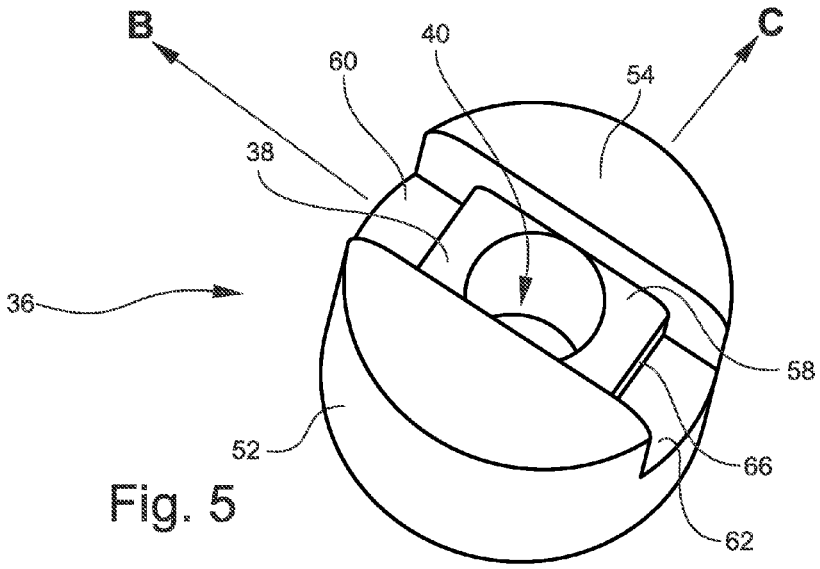
FIG. 5 is a perspective view of a pull pin retainer.

Referring to FIGS. 3 and 4, a grenade fuze assembly 20 includes a fuze body 22 and a striker lever 24 pivotally mounted to fuze body 22. A novel pull pin assembly includes a pull pin 26 and a pull ring 28 attached to pull pin 26. Pull pin 26 may be made of a wire, for example. A pull pin retainer 36 is fixed to an end of pull pin 26. Pull pin retainer 36 is disposed on a side of striker lever 24 opposite pull ring 28.

Figure 6:
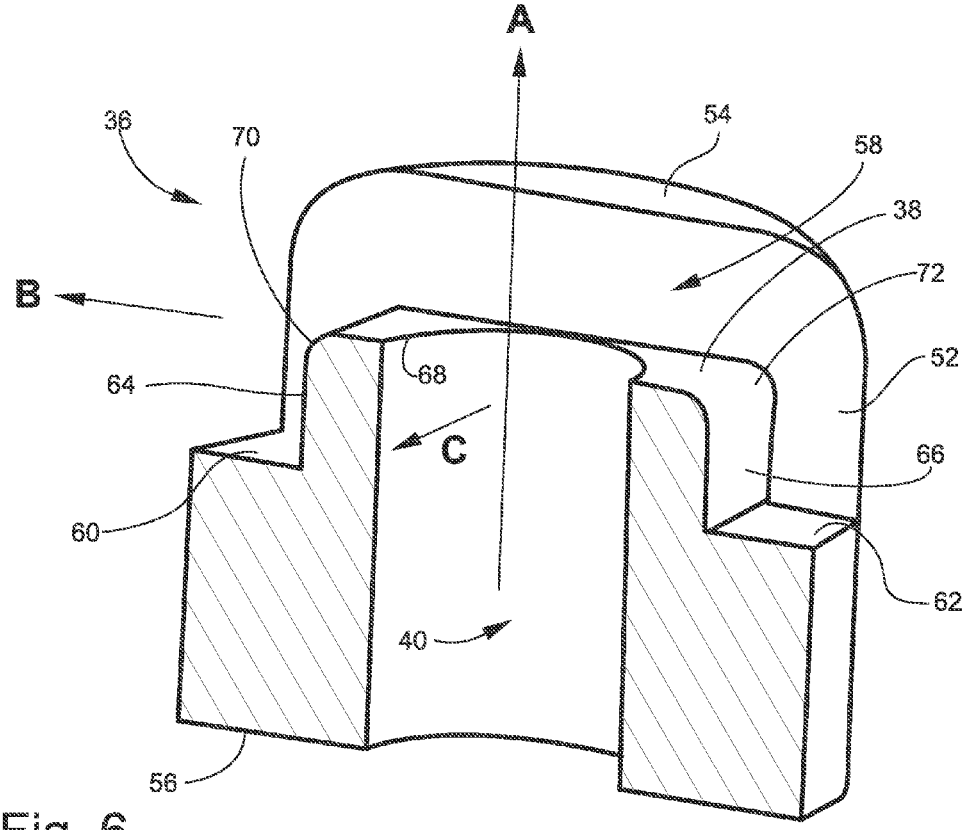
FIG. 6 is a transverse sectional view of the retainer of FIG. 5.

Referring to FIGS. 5 and 6, pull pin retainer 36 has a generally cylindrical body 52 and a central longitudinal axis A. A top surface 54 is parallel to a bottom surface 56. A centrally located through hole 40 is coaxial with axis A. A channel 58 formed in top surface 54 is centered on axis A and extends completely across top surface 54 in a direction B and partially across top surface 54 is a direction C normal to direction B. Channel 58 defines a planar surface 38 that is normal to axis A, parallel to top surface 54, and located below or interior to top surface 54. A pair of coplanar surfaces 60, 62 are disposed on opposite sides of planar surface 38, parallel to planar surface 38, and located further axially away from top surface 54 than planar surface 38. Coplanar surfaces 60, 62 are joined to planar surface 38 by respective surfaces 64, 66. Surfaces 64, 66 may be parallel to each other. Surfaces 64, 66 may be normal to both planar surface 38 and coplanar surfaces 60, 62.

In a known manner, pull pin 26 is inserted through striker lever 24 and fuze body 22 to prevent rotation of striker lever 24. Then, pull pin retainer 36 is fixed to pull pin 26.

Figure 7A:
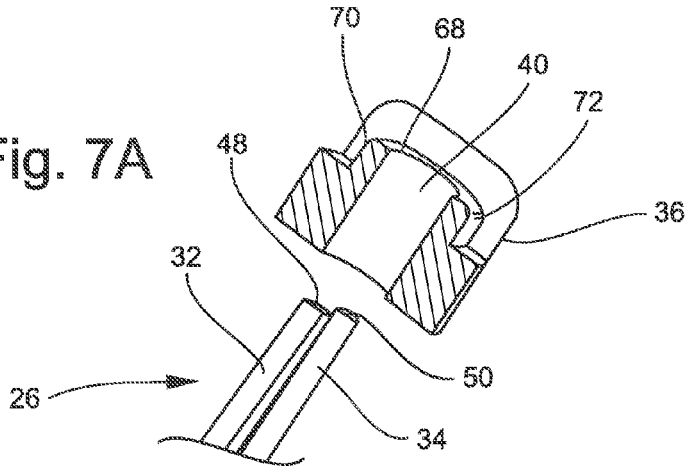
FIGS. 7A-C show three steps in assembling the pull pin retainer to the pull pin. The pull pin retainer is shown in transverse section.
Figure 7B:
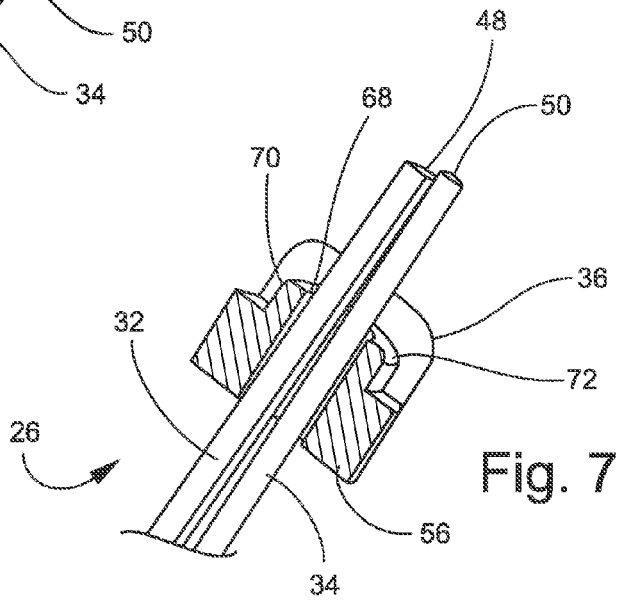
Figure 7C:
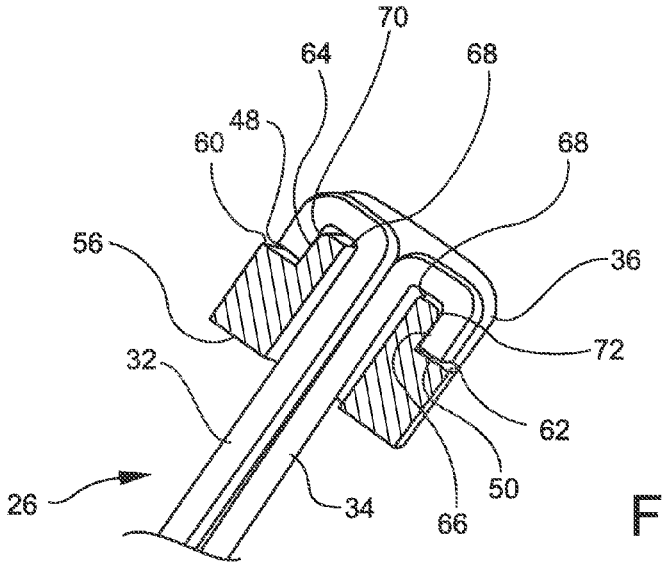

Referring to FIGS. 7A-7C, pull pin 26 has two legs 32, 34. The two legs 32, 34 are inserted into through hole 40. The retainer 36 slides down pin 26 until bottom surface 56 of retainer 36 abuts striker lever 24. Each leg 32, 34 is bent around a fulcrum 68 formed by planar surface 38 and through hole 40. The bend in each leg 32, 34 around fulcrum 68 may be, for example, about ninety degrees. Then, each leg 32, 34 is bent again around respective fulcrums 70, 72. Fulcrums 70, 72 are formed by the intersection of planar surface 38 and surfaces 64, 66, respectively. The bend in each leg 32, 34 around respective fulcrums 70, 72 may be, for example, about ninety degrees.

After legs 32, 34 are twice bent, the free ends 48, 50 of legs 32, 34 rest on or just above respective coplanar surfaces 60, 62. The areas radially outward of surfaces 64, 66 and above coplanar surfaces 60, 62 are "nest" areas for ends 48, 50 of legs 32, 34. Preferably, bottom surface 56 abuts striker lever 24.

The mechanical properties of the material used to make pull pin 26 may be modified to change the pull force needed to remove pull pin 26 from retainer 36. The needed pull pin forces can also be affected by the bend shapes or profiles of retainer 36. Reliance on the mechanical properties of the pull pin material enables a more consistent pull pin force compared to reliance on the geometry of the "duck bill" design.

The use of pull pin retainer 36 can also function as a usage or tampering indicator. After pull pin 26 is removed from the grenade fuze assembly 20, retainer 36 drops off of assembly 20. Because legs 32, 34 of pull pin 26 are deformed past retainer 36, the original bending of legs 32, 34 would be most difficult to replicate. Evidence of an attempt to reassemble retainer 36 to pull pin 26 would most likely be a failure to replicate the original bending and/or scarring or marks on legs 32, 34.

While the invention has been described with reference to certain embodiments, numerous changes, alterations and modifications to the described embodiments are possible without departing from the spirit and scope of the invention as defined in the appended claims, and equivalents thereof.

What is claimed is:

1. A grenade fuze assembly, comprising:

a fuze body;

a striker lever pivotally mounted to the fuze body;

a pull pin assembly including a pull pin attached to a pull ring, the pull pin having two legs inserted through the striker lever and the fuze body to prevent rotation of the striker lever;

a pull pin retainer disposed on a side of the striker lever opposite the pull ring, the pull pin retainer including a through hole with the two legs of the pull pin disposed in the through hole and deformed around the retainer to fix the retainer to the pull pin; and a pair of nest areas within the retainer, the nest areas being disposed on opposing sides of the retainer wherein a free end of each of the two legs is disposed in a respective nest area.

2. The assembly of claim 1, wherein a bottom surface of the pull pin retainer abuts the striker lever.

3. The assembly of claim 1, wherein the pull pin retainer includes a generally cylindrical body, a central longitudinal axis, parallel top and bottom surfaces, and the through hole is coaxial with the central longitudinal axis.

4. The assembly of claim 3, wherein the retainer includes a channel in the top surface, the channel being centered on the central longitudinal axis and extending in a first direction completely across the top surface.

5. The assembly of claim 4, wherein the channel extends only partially across the top surface in a second direction normal to the first direction.

6. The assembly of claim 5, wherein the channel defines a planar surface that is normal to the central longitudinal axis, parallel to the top surface and located interior of the top surface.

7. The assembly of claim 6, wherein the retainer includes a pair of coplanar surfaces disposed on respective opposite sides of the planar surface, the coplanar surfaces being parallel to the planar surface and located axially further from the top surface than the planar surface.

8. The assembly of claim 7, wherein the pair of coplanar surfaces are respectively joined to the planar surface by a pair of second surfaces.

9. The assembly of claim 8, wherein the pair of second surfaces are parallel to each other, normal to the planar surface, and normal to respective ones of the pair of coplanar surfaces.

10. The assembly of claim 9, wherein an intersection of the through hole and the planar surface forms a fulcrum around which each leg of the pull pin is angled.

11. The assembly of claim 10, wherein intersections of the planar surface with respective ones of the pair of second surfaces form respective second fulcrums around which respective ones of the pair of legs are angled.

12. The assembly of claim 11, wherein each of the pair of nest areas is defined by an area that is radially outward of one of the second surfaces and axially above one of the coplanar surfaces that joins the one of the second surfaces.

13. A grenade comprising the grenade fuze assembly of claim 1.

14. A pull pin retainer for retaining a pull pin of a grenade fuze assembly, comprising:

a generally cylindrical body, a central longitudinal axis, parallel top and bottom surfaces, and a through hole that is coaxial with the central longitudinal axis;

a channel formed in the top surface, the channel being centered on the central longitudinal axis and extending in a first direction completely across the top surface and partially across the top surface in a second direction normal to the first direction;

a planar surface that is normal to the central longitudinal axis, parallel to the top surface and located interior of the top surface;

a pair of coplanar surfaces disposed on respective opposite sides of the planar surface, the coplanar surfaces being parallel to the planar surface and located axially further from the top surface than the planar surface;

a pair of second surfaces that join respective ones of the pair of coplanar surfaces to the planar surface;

a fulcrum defined by an intersection of the through hole and the planar surface;

a pair of second fulcrums defined by intersections of the planar surface with respective ones of the pair of second surfaces; and a pair of nest areas, each nest area defined by an area that is radially outward of one of the second surfaces and axially above one of the coplanar surfaces that joins the one of the second surfaces.

15. The assembly of claim 14, wherein the pair of second surfaces are parallel to each other, normal to the planar surface, and normal to respective ones of the pair of coplanar surfaces.

16. The assembly of claim 14, wherein free ends of the pull pin are disposed in respective ones of the pair of nest areas.

17. A grenade fuze assembly, comprising:

a fuze body;

a striker lever pivotally mounted to the fuze body;

a pull pin assembly including a pull pin attached to a pull ring, the pull pin having two legs inserted through the striker lever and the fuze body to prevent rotation of the striker lever; and the pull pin retainer of claim 14 disposed on a side of the striker lever opposite the pull ring, each of the two legs of the pull pin being disposed in the through hole, deformed around the fulcrum, and deformed around a respective one of the pair of second fulcrums;

wherein a free end of each of the two legs is disposed in a respective one of the pair of nest areas.

18. A grenade comprising the grenade fuze assembly of claim 17.

* * * * *